US006971288B2

(12) United States Patent
Wei

(10) Patent No.: US 6,971,288 B2
(45) Date of Patent: Dec. 6, 2005

(54) AUTOMATICALLY ADJUSTING SELF-TIGHTENING WRENCH

(76) Inventor: Chen Wei, 74 Pipashan Zhengjie, Chongquing City, Sichuan Province (CN) 400013

( * ) Notice: Subject to any disclaimer, the term of this patent is extended or adjusted under 35 U.S.C. 154(b) by 0 days.

(21) Appl. No.: 10/033,019

(22) Filed: Dec. 27, 2001

(65) Prior Publication Data

US 2003/0121374 A1 Jul. 3, 2003

(51) Int. Cl.[7] ..... B25B 13/28
(52) U.S. Cl. ..... 81/99; 81/111
(58) Field of Search ..... 81/99, 97, 98, 81/100, 103, 126, 127, 111, 186

(56) References Cited

U.S. PATENT DOCUMENTS

| | | | | | |
|---|---|---|---|---|---|
| 676,318 | A | * | 6/1901 | Jackson | 81/99 |
| 1,395,052 | A | * | 10/1921 | Miller | 81/99 |
| 1,634,908 | A | * | 7/1927 | Lynch et al. | 81/99 |
| 1,763,353 | A | * | 6/1930 | Heller | 81/176.1 |
| 1,900,358 | A | * | 3/1933 | Mead | 81/100 |
| 2,028,406 | A | * | 1/1936 | Mead | 81/98 |
| 2,264,555 | A | * | 12/1941 | Carnelli | 242/579 |
| 2,464,555 | A | * | 3/1949 | Carnelli | 81/99 |
| 2,467,658 | A | * | 4/1949 | Carnelli | 81/99 |
| 2,546,287 | A | * | 3/1951 | Zelgert | 81/98 |
| 2,606,473 | A | * | 8/1952 | Carnelli | 81/101 |
| 2,623,428 | A | * | 12/1952 | Larson | 81/99 |
| 2,644,358 | A | * | 7/1953 | Osborn | 81/98 |
| 2,742,808 | A | * | 4/1956 | Haberle | 81/99 |
| 2,958,246 | A | * | 11/1960 | Osborn | 81/99 |
| 4,616,534 | A | * | 10/1986 | Park et al. | 81/99 |
| 5,771,761 | A | * | 6/1998 | Binkowski | 81/99 |
| 5,927,159 | A | * | 7/1999 | Yokoyama et al. | 81/99 |
| 6,026,714 | A | * | 2/2000 | Chang | 81/100 |
| 6,092,440 | A | * | 7/2000 | Hillinger | 81/117 |
| 6,131,491 | A | * | 10/2000 | Hirse | 81/99 |
| 6,167,784 | B1 | * | 1/2001 | Lin | 81/99 |
| 6,311,586 | B1 | * | 11/2001 | Hirse | 81/99 |

FOREIGN PATENT DOCUMENTS

| | | | | |
|---|---|---|---|---|
| SE | 83 132 | * | 4/1935 | 81/99 |

* cited by examiner

*Primary Examiner*—Hadi Shakeri
(74) *Attorney, Agent, or Firm*—Donn K. Harms

(57) ABSTRACT

A self-adjusting wrench having a handle and a jaw member rotationally attached thereto. A smoothly curved handle face opposes a planar face on the jaw member which adjusts for distance from the curved handle face by following a generally circular path around a pinned attachment of the jaw member to the handle. A spring or similar biasing device continuously urges the jaw member toward the handle thereby making the device self adjusting to the size of the object placed between the jaw member and the curved handle surface.

8 Claims, 1 Drawing Sheet

AUTOMATICALLY ADJUSTING SELF-TIGHTENING WRENCH

FIELD OF THE INVENTION

The disclosed device relates to a self adjusting self tightening wrench. More particularly it relates to a wrench with a handle and rotationally pivoting jaw member which form a substantially parallel grip on objects throughout the range of rotation of the jaw member which will accommodate an infinite number of sizes of objects to be rotated by the wrench between the wrench's minimum and maximum mouth openings.

BACKGROUND OF THE INVENTION

Adjustable wrenches in the past have generally been of a type which laterally translates a moveable jaw member away from and toward and fixed working surface on the wrench handle. By translating the jaw member further away, using a geared mechanism, the distance between the fixed working surface on the handle and the moveable working surface of the jaw member may be increased to a finite distance. This allows such adjustable wrenches to accommodate a range of sizes of bolts, pipes, nuts, or other objects needing rotational movement. Similar adjustable pliers allow for the increase of the dimension between the working surface of the fixed handle and the pivoting jaw member by slidable engagement of cooperatively engageable tracks on both the handle and the jaw member. This again allows for adjustment of the distance between the working surface of the jaw member and the handle to be adjusted to accommodate the object being gripped for rotation.

Such conventional adjustable wrenches do however provide for a continuous and automatic adjustment of the force or tightness of the "grip" which the wrench had on a work piece. Consequently, because the adjustable wrench was not sized to the object being worked on, slippage occurred of the wrench on the object being turned resulting in a "knuckle buster" which has been a constant source of aggravation to the user of such wrenches. Further, such adjustable wrenches generally require some movement of an adjusting mechanism by the user which requires two hands and a reasonable high amount of dexterity.

As such, there is a pressing need for an easily functioning adjustable wrench. Such a wrench should automatically adjust to the object placed between its jaws. Such a wrench should not slip when twisted and should ideally increase the force of the grip on the object being rotated between the jaws when the force on the wrench is increased. Further, such a wrench should maintain relatively equal pressure on both sides of the object being twisted to maximize grip and minimize distortion of the object of the wrench's force.

SUMMARY OF THE INVENTION

The above problems, and others are overcome by the herein disclosed automatically adjusting self tightening wrench. The device is composed of a handle and rotating jaw member having a gripping surface area on a distal face of the jaw member. The jaw member is rotationally attached to the handle at the opposite end from the area to be gripped by the user. The rotation of the jaw member is generally about a pin or axle used to secure it to the distal end of the handle. In the current best mode, the jaw member rotates about the pin and into a slot grooved into the handle just below the pin thereby allowing the jaw member to rotate on the pin with the attachment end of the jaw member rotating into the slot.

The gripping surface area of the jaw member at an angle substantially normal to the center axis of the elongated handle when the jaw member is in a fully biased position rotated to its closest point to the work surface formed on the end of the handle. The handle gripping surface is formed on a working face portion shaped like an arc. When the jaw member rotates about the axle, the jaw gripping surface area of the jaw member becomes increasingly distant from the handle gripping surface formed on the arced face of the handle because both circles have different center points. This increase in distance allows the device to accommodate larger and larger objects between the jaw gripping surface and the handle gripping surface as the jaw member is rotated to increase the distance of the planar face of the jaw member and the jaw gripping surface thereon, away from the handle gripping surface on the handle face.

A biasing means such as the spring shown in the current best mode of the device, is in communication at one end with the static handle and at the other with the rotating jaw member and biases the jaw gripping surface area on the planar face of the jaw member toward the handle gripping surface formed on the arcing face of the handle, at all times. This allows the device to immediately self adjust to the diameter of the object placed between the gripping surface on the face of the jaw member and the jaw gripping surface on formed on the face of the handle opposite the end to be held by the user.

Unique to the disclosed device is the maintaining of generally parallel contact between gripping surfaces no matter what the size of the object inserted therebetween. This is accomplished by the arc shape forming the working face on the handle on which the handle gripping surface resides. By forming the working surface in an arc, and forming the jaw gripping surface on a generally planar face that is normal to the center axis of the handle at its closest position, when the jaw is rotated about the axle pin on the handle, a generally parallel contact of both gripping surfaces on the object therebetween is maintained. As can be seen, the actual surface area of an object touching the arced surface of the gripping end of the handle is very small thus providing the generally parallel contact between both gripping surfaces at all points in the rotation of the jaw member.

In the current best mode, teeth or a gnarled surface would be provided on both the arced face of the handle and the planar face of the jaw member. This allows for a better frictional connection between the object being rotated between the jaw member and the handle during use. The formed teeth or other frictionally engaging surface are best angled to allow maximum grip when the wrench is torqued in the direction of object rotation which occurs when the gripping end of the handle is forced toward mouth opening formed between the jaw member and the arced handle face. The arrangement of angling the teeth would also allow the device to slip when the wrench is pulled in the opposite direction of intended rotation which occurs when the hand grip end of the handle is pulled away from the mouth opening. This allows the device to slip in one direction and grip progressively harder in proportion to the force applied in the other direction.

Finally provided to make the device even more user friendly is the thumb grip on the exterior surface of the jaw member. This area of the jaw member is notched or otherwise surfaced for easy frictional engagement of the user's thumb or finger with the jaw member. This allows the user, with only one hand, the place the mouth opening of the device over the object for rotation and then to pull open the jaw member still using one hand by simply pressing with the thumb or finger on the thumb grip to overcome the force of the biasing means and remove or readjust the device from the object being turned.

Accordingly, it is the object of this invention claimed herein to provide a simplified and easy to use self adjusting wrench which will tighten its grip on the object being turned as the force applied to the handle is increased.

It is another object of this invention to supply such a self adjusting wrench that will relax its grip on the object being turned and slip when pulled in the opposite direction of intended object rotation.

It is still another object of this invention to provide such a self adjusting wrench which has a biased jaw allowing the user to use the device with only one hand and secure it over the object to be turned.

It is a still further object of this invention to provide an easy thumb release on the jaw of the device such that the user can release it from engagement with the object to be turned still using one hand and the thumb to overcome the biasing means.

It is yet another object of this invention to provide a self adjusting wrench which by using a curved gripping surface on the handle and planar surface on the jaw maintains a substantially parallel engagement upon the object being turned by the wrench and substantially equal imparting of force by each working face upon the object turned.

Further objectives of this invention will be brought out in the following part of the specification, wherein detailed description is for the purpose of fully disclosing the invention without placing limitations thereon.

BRIEF DESCRIPTION OF THE DRAWING FIGURES

The accompanying drawings which are incorporated in and form a part of this specification illustrate embodiments of the disclosed processing system and together with the description, serve to explain the principles of the invention.

DETAILED DESCRIPTION OF THE PREFERRED EMBODIMENTS

Figure 1:
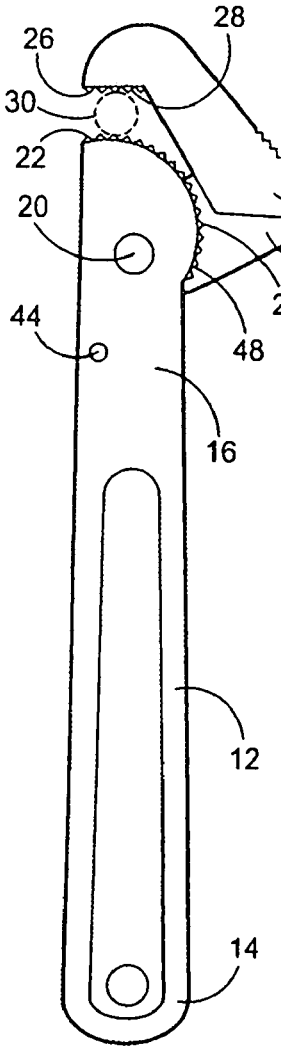
FIG. 1 depicts a side view of the disclosed self adjusting wrench showing it with the jaw gripping surface in the closest position to the handle gripping surface.
Figure 2:
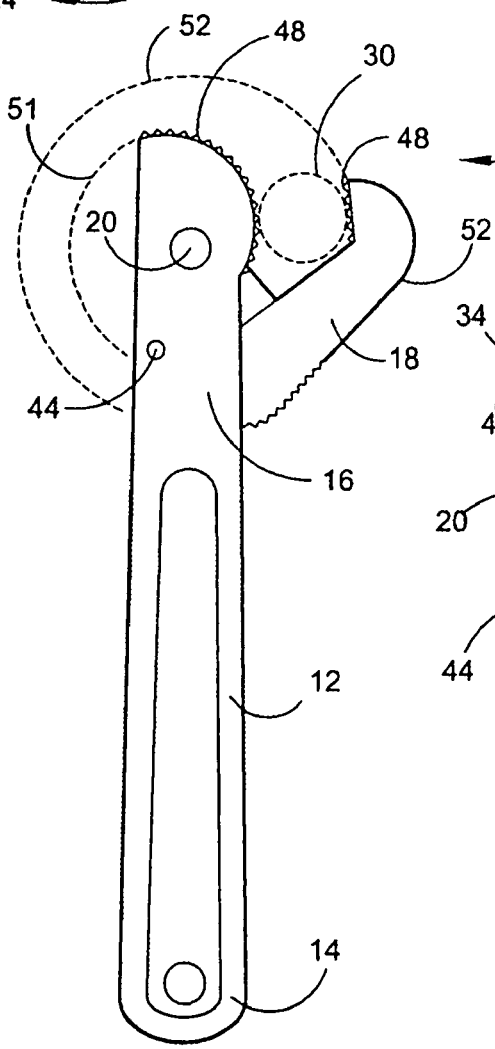
FIG. 2 depicts a side view of the disclosed self adjusting wrench showing the jaw gripping surface of the jaw member in the position furthest from the jaw gripping surface of the handle.
Figure 3:
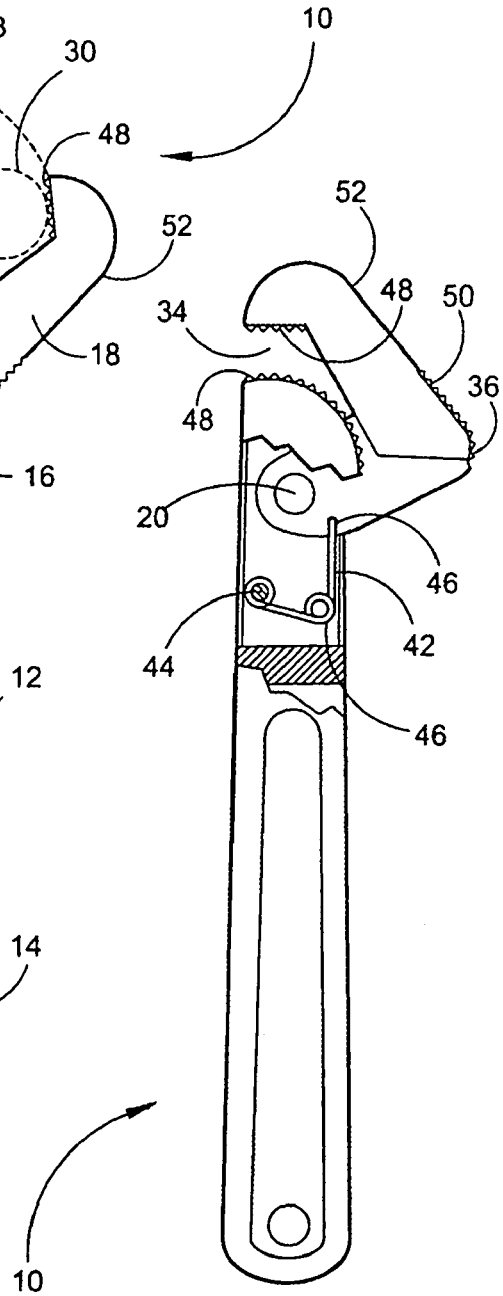
FIG. 3 shows a side view of the device with the handle cut away to reveal the interior cavity for travel of the jaw member on the axle pin and the biasing means.

FIGS. 1–3 preferred embodiments of the disclosed device 10 with FIG. 1 depicting a side view of the disclosed self adjusting wrench device 10. The device 10 features a handle 12 having a grasping end 14 and a working end opposite the grasping end 14.

A rotatingly mounted jaw member 18 is mounted to the handle 12 at th working end 16 using a pin 20 or axle which communicates into the handle 12 and jaw member 18 and attaches the jaw member 18 in rotational engagement with the handle 12 about the working end 16 of the handle 12.

On the working end 16 of the handle 12 arc shaped handle working face 22 is formed and on this handle working face 22 a handle gripping surface 24 is formed. The current best mode of the device 10 features the handle working surface 22 in an arc and forming the jaw gripping surface 26 on a generally planar face 28 of the jaw member 18 opposite the handle working face 22. By forming the jaw gripping surface 26 on a substantially planar jaw planar face 28 and rotating that gripping surface 26 around the arced handle gripping surface 24 the object 30 which is to be rotated is gripped at two substantially parallel contact points no matter what rotational position the jaw member 18 and jaw member gripping surface 26 is located in relation to the handle gripping surface 24 on the arced handle working face 22. This curve or arc of the handle working face 22 and the handle gripping surface 24 thereon, combined with the rotation of the jaw gripping surface 26 around it during rotation of the jaw member 18 thus provides substantially parallel contact points on both sides of a gripped object 30 no matter what point the jaw member 18 has rotated to accommodate the size of the object 30. This of course substantially equalizes the pressure imparted to both sides on which the object is gripped by the device 10.

The rotation of the jaw member 18 is as noted provided by the axle formed by the pin 20 used to secure the jaw member 18 to and in rotational engagement at the working end 16 of the handle 12. In the current best mode, the jaw member 18 rotates about the pin and into a slot 32 grooved into the handle 12 just below the pin 20 providing a relief into which one end of the jaw member 18 may rotate into on the handle 12.

Automatic adjustment of the device 10 to the size of the object 30 is provided by the rotation of the jaw member 18 about the pin 20. As the jaw member 18 rotates, the jaw gripping surface 26 on the jaw planar face 28 follows a circular path around the pin 20 but becomes increasingly distant from the handle gripping surface 24 formed on the arced handle working face 22. This resulting increase in distance allows the device to accommodate larger and larger objects 30 between mouth 34 formed between the jaw gripping surface 26 and the handle gripping surface 24. The maximum size of the mouth 34 so formed would be determined by the maximum distance of the jaw gripping surface 26 from the handle gripping surface 24 and also by changing the angle of the elbow 36 where it intersects the first jaw member strut 36 and angles back on the second jaw member strut 38 to determine the position of the jaw planar face 28 in relation to the handle working face 22. Increasing the angle of the elbow 36 would increase the smallest size of the mouth 34 and the resulting largest size of the mouth depicted in FIG. 3. Also seen in FIG. 3 are the two substantially circular paths 51 and 52 followed by the handle working face 24 and the jaw planar face 28 respectively. These offset circular paths followed by both surfaces thus increase and decrease the distances between the two allowing for the size of the mouth 34 to increase and decrease for the size of the object 30.

A means to bias the jaw gripping surface 26 toward the handle gripping surface 24 is provided in the current best mode by the spring shown in the current best mode of the device 10. The spring 42 also in the current best mode has an elbow shape and is sized to reside inside the slot 32 during use. As depicted the spring 42 is attached inside the slot 32 at a first end using a set screw 44 and to the jaw member 18 at the opposite end in frictional engagement with an aperture 46. This type of spring bends at the spring elbow 46 and therein biases the jaw member 18 and affixed jaw gripping surface 26 area on the jaw planar face 28 under biased force toward the handle gripping surface 24 formed around the arced handle working face 22. This bias allows the device to immediately self adjust to the diameter of the object 30 placed in the mouth 34 by biasing the jaw member 18 back toward the handle gripping surface 24 at all times. It also provides the ability to used the device with only one hand by simply engaging the object to be turned into the mouth and rotating the handle 12 toward the mouth side of the device 10.

In the current best mode, teeth 48 or an otherwise gnarled surface would be provided on both the arced handle gripping surface 24 and the jaw planar face 28 of the jaw member 18. These teeth 48 allow for a better frictional connection between the object 30 being rotated and the gripping surfaces on the jaw member 18 and the handle 12 during use. The formed teeth 48 are best angled to allow maximum grip when the wrench is torqued in the direction of object rotation which occurs when the gripping end 14 of the handle 12 is forced toward mouth side of the handle formed between the jaw member and the arced handle face. The arrangement of angling the teeth 48 would also allow the device 10 to slip when the wrench is pulled in the opposite direction of intended rotation which occurs when the griping end 14 of the handle 12 is pulled away from the mouth opening. This allows the device to slip in one direction and grip progressively harder in proportion to the force applied in the other direction. The curved surface of the hand gripping surface 24 tends also to turn into the object being held grabbing it tighter as more force is applied.

Finally, in the current best mode of the device 10 a biasing release is provided to make the device even more user friendly and useable by one hand. This is provided by the thumb grip 50 on the exterior surface 52 of the jaw member 18 and could be surfaced with teeth 48 or other frictional engagement style surfacing. The thumb grip 50 allows the user, with only one hand, to place the mouth 34 opening of the device over the object 30 for rotation and then to pull open the jaw member 18 still using one hand by simply pressing with the thumb or finger on the thumb grip 50 to overcome the force of the biasing means and remove or readjust the device 10 from the object being turned.

While all of the fundamental characteristics and features of the automatically adjusting self tightening wrench have been shown and described, it should be understood that various substitutions, modifications, and variations may be made by those skilled in the art, without departing from the spirit or scope of the invention. Consequently, all such modifications and variations are included within the scope of the invention as defined by the following claims.

What is claimed is:

1. A self-adjusting tightening wrench comprising:

a handle having a center axis, a gripping end and a working end;

a jaw member rotationally attached at an attachment end at a fixed point to said working end of said handle;

said working end of said handle having a continuously curved handle face;

said continuously curved handle face shaped substantially in a smooth arc formed substantially along a circumference of a first circular path around a first center point adjacent to said fixed point;

said jaw member having a planar face opposing said curved handle face;

said jaw member having a first jaw member strut between said fixed point and an elbow;

said jaw member having a second jaw member strut in an angled engagement with said first jaw member strut and extends from said elbow to said planar face;

said angled engagement a distance of said elbow from said fixed point determining a second circular path followed by said planar face around said curved handle face when said jaw member is rotated;

means to bias said planar face of said jaw member toward said handle face;

a thumb grip defined by a substantially flat surface area formed on said second jaw member strut adjacent to said elbow, said thumb grip engageable by a thumb of the hand of a user while holding said gripping end of said handle with the fingers of said hand; and said planar face following said second circular path around said fixed point and around said first circular path when said jaw member is rotated, thereby moving from a first point where said planar face is substantially normal to said center axis at a minimum distance from said curved handle face, to a second point a maximum distance from said curved handle face whereby said self-adjusting tightening wrench may be placed over an object to be rotated and said object size is accommodated by rotation of said jaw member to increase or decrease distance between said curved handle face and said planar face.

2. The self-adjusting tightening wrench of claim 1 wherein a gnarled surface is provided on both said planar face and said curved handle face.

3. The self-adjusting tightening wrench of claim 2 additionally comprising a slot formed in said handle at said working end, said slot adjacent to said fixed point whereby said jaw member rotationally translates into said slot when rotating around said fixed point attachment toward said working end of said handle.

4. The self-adjusting tightening wrench of claim 3 wherein said first jaw member strut is rotationally engaged with said fixed point and rotationally translates within said slot.

5. The self-adjusting tightening wrench of claim 1 wherein said means to bias said planar face of said jaw member toward said handle face is a spring attached at a first end to said working end of said handle and at a second end to said first jaw member strut.

6. The self-adjusting tightening wrench of claim 5 additionally comprising a slot formed in said handle at said working end, said slot adjacent to said fixed point whereby said jaw member rotationally translates into said slot when rotating around said fixed point attachment toward said working end of said handle.

7. The self-adjusting tightening wrench of claim 1 additionally comprising a slot formed in said handle at said working end, said slot adjacent to said fixed point whereby said jaw member rotationally translates into said slot when rotating around said fixed point attachment toward said working end of said handle.

8. The self-adjusting tightening wrench of claim 6 wherein said first jaw member strut is rotationally engaged with said fixed point and rotationally translates within said slot.

* * * * *